US005797237A

United States Patent [19]

Finkell, Jr.

[11] Patent Number: 5,797,237

[45] Date of Patent: Aug. 25, 1998

[54] FLOORING SYSTEM

[75] Inventor: Donald R. Finkell, Jr., Spartanburg, S.C.

[73] Assignee: Standard Plywoods, Incorporated, Clinton, S.C.

[21] Appl. No.: 807,242

[22] Filed: Feb. 28, 1997

[51] Int. Cl.[6] ..... E04B 2/08

[52] U.S. Cl. ..... 52/589.1; 52/586.1; 52/590.2

[58] Field of Search ..... 52/578, 592.1, 52/592.3, 590.1, 590.2, 591.1, 586.1

[56] References Cited

U.S. PATENT DOCUMENTS

| | | | |
|---|---|---|---|
| 714,987 | 12/1902 | Wolfe | 52/578 |
| 3,538,819 | 11/1970 | Gould et al. . | |
| 3,731,445 | 5/1973 | Hoffmann et al. . | |
| 3,740,914 | 6/1973 | Diez | 52/392 X |
| 3,914,913 | 10/1975 | Roberts . | |
| 4,426,820 | 1/1984 | Terbrack et al. | 52/590.1 |
| 4,845,907 | 7/1989 | Meek . | |
| 5,050,362 | 9/1991 | Tal et al. . | |
| 5,052,158 | 10/1991 | D'Luzansky . | |
| 5,179,812 | 1/1993 | Hill . | |
| 5,630,304 | 5/1997 | Austin | 52/592.1 X |

FOREIGN PATENT DOCUMENTS

| | | | |
|---|---|---|---|
| 444123 | 8/1949 | Italy | 52/592.1 |

*Primary Examiner*—Creighton Smith

*Attorney, Agent, or Firm*—Leatherwood Walker Todd & Mann, P.C.

[57] ABSTRACT

A snap-together flooring system which fixes adjacent flooring members from lateral movement with respect to one another. A first flooring member includes a channel having a downwardly extending barb. A second flooring member includes an outwardly extending tongue having a groove defined therein. The first and second flooring members are snapped together by moving the tongue into the channel, which causes the barb to ride upwardly on an inclined face of the tongue in an elastic manner, and to ultimately snap downwardly into place within the groove of the tongue. The engagement of the barb in the groove of the tongue prevents laterally removal of the tongue from the channel, and thus holds the adjacent flooring members together. Disengagement of the flooring members is provided by lifting of the interface between the adjacent flooring members and rotating the flooring member having the tongue downwardly in order to disengage the barb from the groove of the tongue, and to thus allow extraction of the tongue from the channel.

15 Claims, 5 Drawing Sheets

FLOORING SYSTEM

BACKGROUND OF THE INVENTION

This invention relates generally to a snap-together panel or flooring system.

Flooring systems are available in the form of relatively short panels, which may include the artistic or photographic image of a simulated wood grain surface. These panels are constructed using a masonite-substrate, which is constructed of wood fibers, to which the image is applied to a surface thereof. Pressed against the surface is a layer of melamine and aluminum oxide, which is fused against the image, which is usually a photographically-produced layer, and masonite substrate in a press machine. This produces an extremely hard an durable surface with the image being visible through the melamine layer. These panels are laid end-to-end during installation, which results in a floor having an appearance of wood-grained segments.

A drawback of this arrangement is that such panels require the edged portions thereof to be porous for receiving fastening glue used to attach adjacent panels together. So long as the glue is properly applied to the joints, water infiltration into the flooring members should be minimized. However, if the glue is not applied properly, water or other liquid can seep into the porous edge portions of the panels, thereby causing delamination and bubbling-up of the flooring surface.

Flooring designs have been patented in the past. British Patent No. 812,617 discloses flooring having rubber members of rectangular or square shape. Adjacent members are engaged with one another by snap action through pressure directed perpendicularly to the joint line between the adjacent members. U.S. Pat. No. 3,914,913, issued to Roberts, discloses a snap interlock deck structure of extruded aluminum capable of snap interlocking installation on floor joists. U.S. Pat. No. 3,731,455, issued to Hoffmann, et al, discloses floor tiles which are joined together by cutting away material along the edges thereof so as to leave downwardly-extending undercut projections. The tiles are joined together by using a strip having a pair of channels which receive the projections from two different tiles. U.S. Pat. No. 5,179,812, issued to Hill, discloses a wood panel having a plurality of aluminum battens connected to the base of the panel. U.S. Pat. No. 5,052,158, issued to D'Luzansky, discloses a modular locking floor covering having panels with interlocking means composed of spaced locking fingers and locking apertures and secondary locking means in the form of tabs in the face of the finger and the base of the aperture. Each tab has a face inclined in a direction opposite to the inclined face of an adjacent tab.

Other interlocking designs which have been patented include U.S. Pat. No. 5,050,362, issued to Tal, et al, which discloses construction panels for roofing and the like which become locked "so as to define a connection which is highly resistant to both clockwise and counter-clockwise movements applied about a connection axis" (column 3, lines 53–56). U.S. Pat. No. 3,538,819, issued to Gould, discloses air field matting having interlocking members. Finally, U.S. Pat. No. 4,845,907, issued to Meek, discloses interlocking panel modules usable for decking sections in poultry operations.

While the foregoing designs are known, there still exists a need for the flooring system which is relatively straightforward to manufacture, durable, and relatively easy to install.

SUMMARY OF THE INVENTION

It is, therefore, the principal object of this invention to provide a snap-together panel or flooring system of durable construction.

Another object of the present invention is to provide a flooring system which is relatively easy to install and to remove.

Yet another object of the present invention is to provide a flooring system having elongated flooring members with relatively constant dimensions throughout the length thereof.

Still another object of the present invention is to provide a flooring system having flooring members which can be snapped together during installation, without the use of glue, adhesives, nails, screws, or other such fastening means.

A still further object of the present invention is to provide methods of manufacturing, installing, and removing a flooring system of the present invention.

Generally, the present invention includes a flooring system having elongated flooring members provided with mating side portions. These mating side portions allow the flooring members to be snapped together in an interlocking relationship, without the use of glue, staples, nails, or other fastening means.

The flooring system of the present invention provides water-sealed edges, and a porous glue-receiving surface is not required at the edge portions thereof for installation. Because of the snap-together arrangement of the present flooring system, installation is facilitated and lends itself to use by professional floor installers and homeowners alike.

A significant feature of the flooring system of the present invention is that each flooring member includes on one longitudinal edge thereof a retaining barb which, when adjacent flooring members are snapped together, prevents the flooring members from being pulled apart laterally. The other longitudinal edge of each flooring member includes a nose, or tongue, with a ramped portion thereof which engages the barb, and allows for the members to be snapped together by forcing adjacent longitudinal edges together using a generally, laterally-directed force.

If there is a requirement to remove the flooring members, this can be done relatively easily by simply pulling upwardly along the joints between adjacent flooring members, which will then cause the flooring members to become unsnapped from one another.

Further, a waterproof coating, such as a paraffin-based material, or some other commonly available wood coating, can be applied during manufacture on the longitudinal edges of the flooring members to ensure a good, water-tight interface between the members, thereby preventing delamination and bubbling up of the floor when the flooring members are constructed of masonite or some other water-absorbent material.

In one preferred embodiment of the present invention, the flooring members are produced in an elongated form, approximating the length of a typical floor plank, and being perhaps several inches in width. These elongated floor members could generally resemble flooring boards currently used in flooring in American homes and businesses. The elongated members can be provided with mating side portions, which allow the members to be snapped together in an interlocking relationship without the use of glue, staples, nails, or other fastening means. This is an advantage over the prior art, in that panels presently used may require the edge portions thereof to be porous for receiving fastening glue in order to attach adjacent panels together. So long as the glue is properly applied to those joints, water infiltration into the flooring members should be minimized. However, if the glue is not applied properly, water can seep into the porous edge portions of the panels, thereby causing delamination and bubbling up of the flooring surface.

The present invention allows for ready-made, water-sealed edges, since a porous, glue-receiving surface is not required at the edge portions of the elongated members.

The present invention also includes individual flooring members for use in the flooring system and also includes methods for installation and removal of the flooring system and also for manufacture of individual flooring members.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
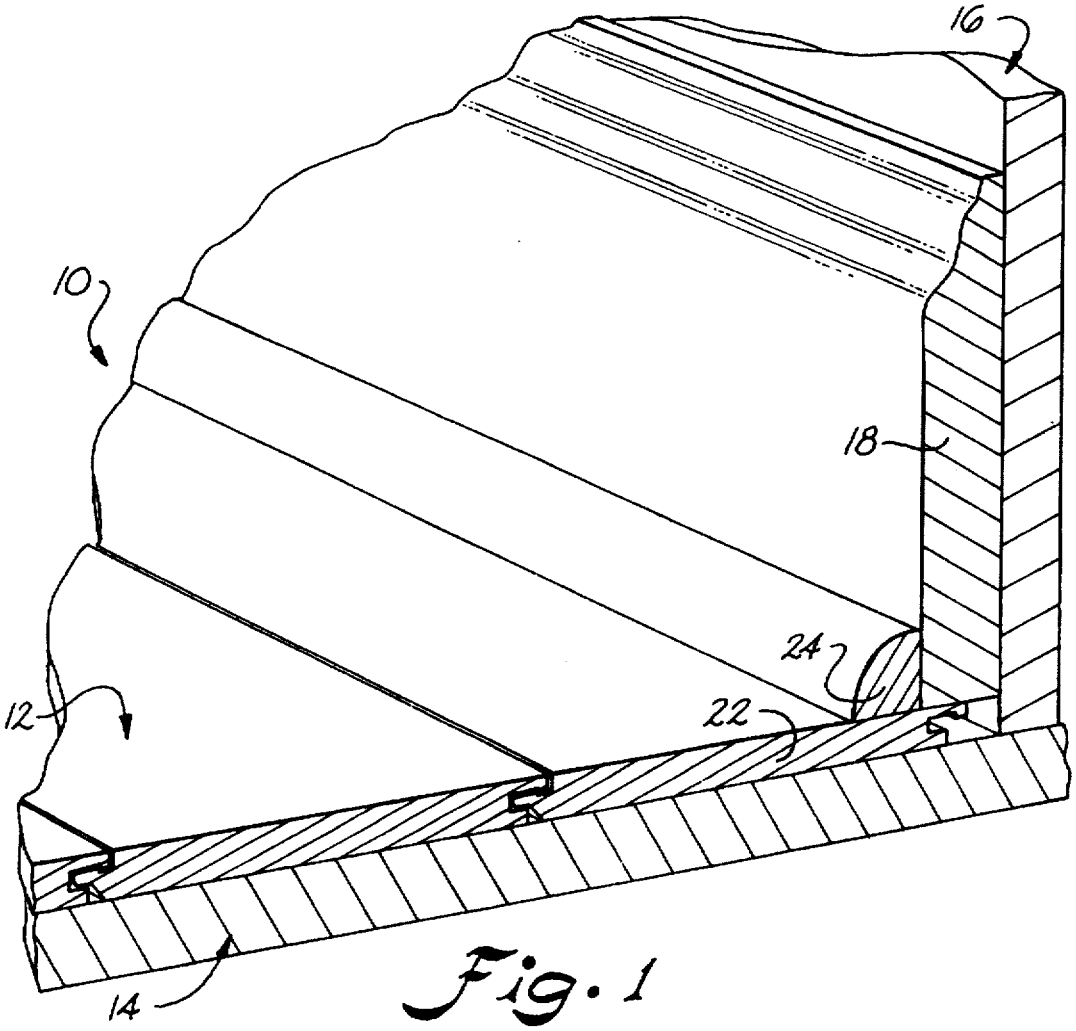
FIG. 1 is a prospective view illustrating the flooring system of the present invention in place.

The accompanying drawings and the description which follows set forth this invention in its preferred embodiment. However, it is contemplated that persons generally familiar with panel and flooring systems will be able to apply the novel characteristics of the structures and methods illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the flooring system of the present invention is indicated generally in the figures by reference character 10.

Turning to FIG. 1, the flooring system 10 of the present invention is illustrated as being installed in a typical environment. Flooring system 10 includes a plurality of elongated panels or flooring members, generally 12, being placed adjacent to one another in an interlocking relationship In the configuration illustrated in FIG. 1, flooring system 10 is placed upon a base surface, or sub-floor, generally 14, and abuts a substantially vertical wall portion, generally 16. Molding member 18 is connected to wall 16 above the extreme end flooring member 22, and a second molding member 24 may be attached to molding member 18, if desired. Molding members 18, 24 are provided primarily for aesthetic purposes, and are not required by the present invention. Although not shown, it is to be understood that the interlocking panels 12 could also be used for vertical wall surfaces or ceilings, if desired.

Figure 2:
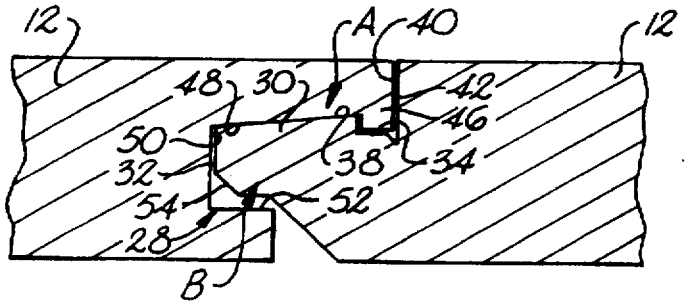
FIG. 2 is a sectional view of the interface between two adjacent flooring members of a flooring system constructed in accordance with the present invention.

The interlocking relationship of adjacent flooring members 12 is illustrated in more detail in FIG. 2. A flooring member 12 includes along one longitudinal edge an engagement portion having a female interface, generally A, and on the other longitudinal edge thereof, an engagement poriton having a male interface, generally B. Female interface includes a channel 28 for receiving a tongue 30 projecting outwardly from male interface edge B. Tongue 30 includes an extreme end face, or leading edge, 32, and a longitudinally-extending groove 34 inwardly from end face 32. Extending between end face 32 and groove 34 is an engagement surface 38. On the other side of groove 34 is a substantially vertical face 40 which fits substantially flush against a second substantially vertical face 42 provided on the extreme end of 25 female interface edge A. The second engagement surface 42 of engagement interface A terminates in a downwardly projecting ridge or barb 46. Adjacent ridge 46 is a third engagement surface 48 which is adjacent surface 38 of interface edge B when adjacent floor members 12 are interconnected with one another, in a manner hereinafter described. Extending downwardly from surface 48 of interface edge A is a substantially vertically-extending wall 50, which terminates into a substantially horizonal wall 52, both walls 50 and 52 forming, together with surface 48, channel 28.

Figure 3A:
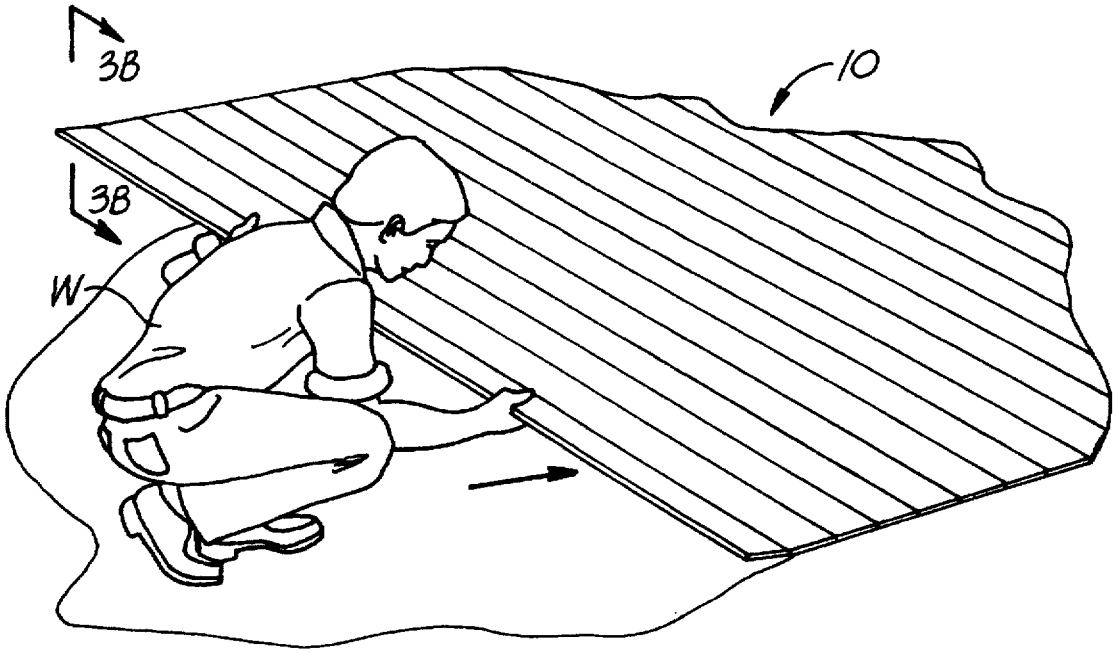
FIG. 3A is a perspective view illustrating installation of a flooring member of a flooring system of the present invention.
Figure 3B:
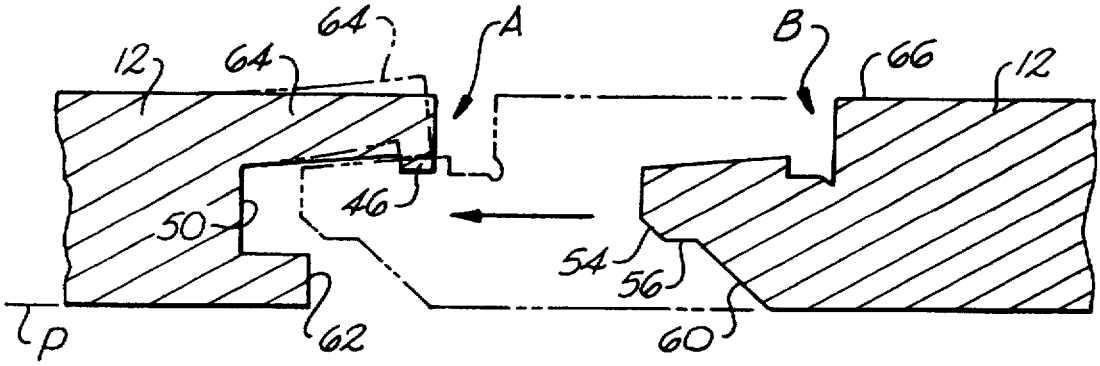
FIG. 3B is a sectional view taken along lines 3B—3B of FIG. 3A.

Turning back now to interface edge B, and as shown in FIG. 3B, extending downwardly from end face 32 of tongue 30 is an inwardly-angled undercut portion 54 which terminates in an adjacent surface 56. Surface 56 then terminates in a second undercut portion 60, which, when adjacent flooring members 12 are interconnected with one another, is spaced from a terminal face 62 of female interface edge A.

FIGS. 3A and 3B illustrate the method of installation of flooring members 12. As illustrated in FIG. 3B, when installing adjacent flooring members 12 adjacent to each other, the female interface edge A is held stationary in a plane P, while nail interface edge B is moved substantially laterally about plane P such that tongue 30 of male edge B is inserted into channel 28 of female edge A.

As tongue 30 is pressed into channel 28, an upper rib 64 of female interface edge A, which includes ridge 46, flexes slightly upwardly, and ridge 46 rides slightly upwardly on surface 48 of tongue 30, which is preferably slightly inclined upwardly, and as the extreme end 32 of tongue 30 approaches vertical surface 50 of channel 28, snaps into place within groove 34 of male edge B. Once ridge 46 snaps downwardly into place into groove 34, the upper surface 64 of edge A, which had flexed upwardly as ridge 46 rode upwardly upon surface 48, reassumes a horizontal disposition, as shown in FIG. 2. In other words, surface 64 becomes flush with adjacent surface 66 on interface edge B. Due to the receipt and engagement of ridge 46 in groove 34, male edge B is fixedly connected to female edge A, and male edge B cannot laterally be separated from female edge A by simply moving male edge B in a lateral direction opposite to the direction in which edge B was previously moved in connecting edges A and B together.

Thus, in such an arrangement, additional flooring members 12 can be connected to one another in like manner, as shown being done by an installer or worker W in FIG. 3A. Although flooring members 12 are illustrated as all having approximately the same length in FIG. 3A, it is to be understood that flooring members 12 could be staggered lengthwise with respect to one another if desired. Staggering the flooring members 12 lengthwise with respect one another would still provide the interlocking relationship of female and male edges A and B as discussed above.

During installation, the installer W would typically start installing flooring members with the first flooring member abutting a wall, and then the additional floor members 12 are subsequently installed in like manner as discussed above until the desired width of flooring has been reached. Although, as discussed above, female interface edge A can be held stationary, while male interface edge B is interlocked therewith, alternately, male interface edge B could be held stationary, with female interface edge being moved laterally in a direction opposite to the arrow a as shown in FIG. 3B. This would also yield the interlocking fit.

Using the method of installation of floor members 12 set forth above requires no additional fastening means in laying flooring system 10. The flooring members 12 do not require nailing to the sub-floor 14, nor are any screws or other fasteners required. Additionally, no adhesive is required to connect flooring members 12 to sub-floor 14, since flooring system 10 remains in place by virtue of its own weight and the interlocking relationship of adjacent members and sidewalls 16.

Figure 4A:
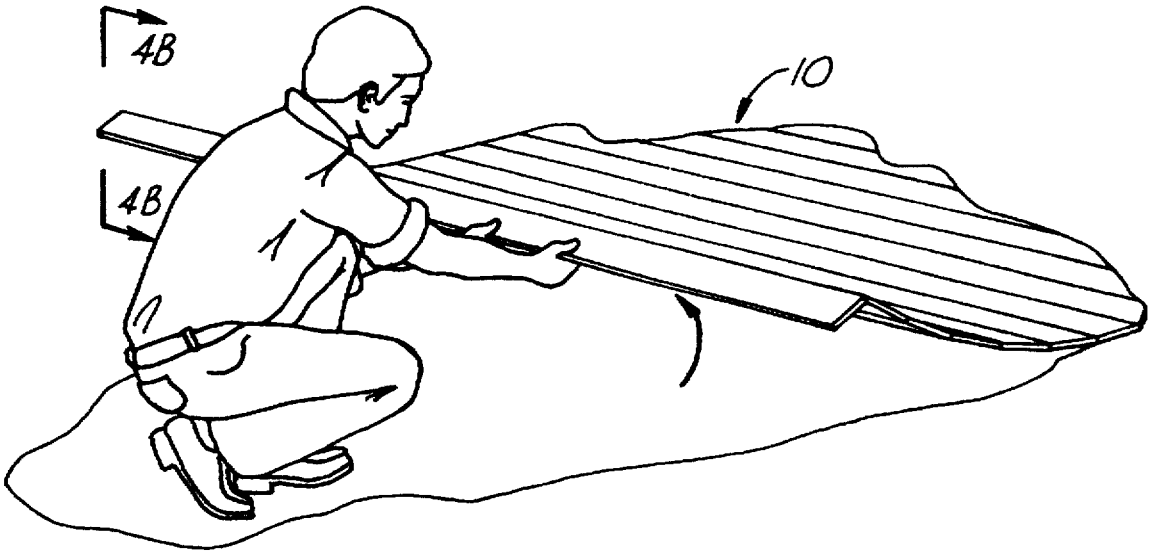
FIG. 4A is a perspective view of a flooring member being removed from a partially-installed flooring system constructed in accordance with the present invention.
Figure 4B:
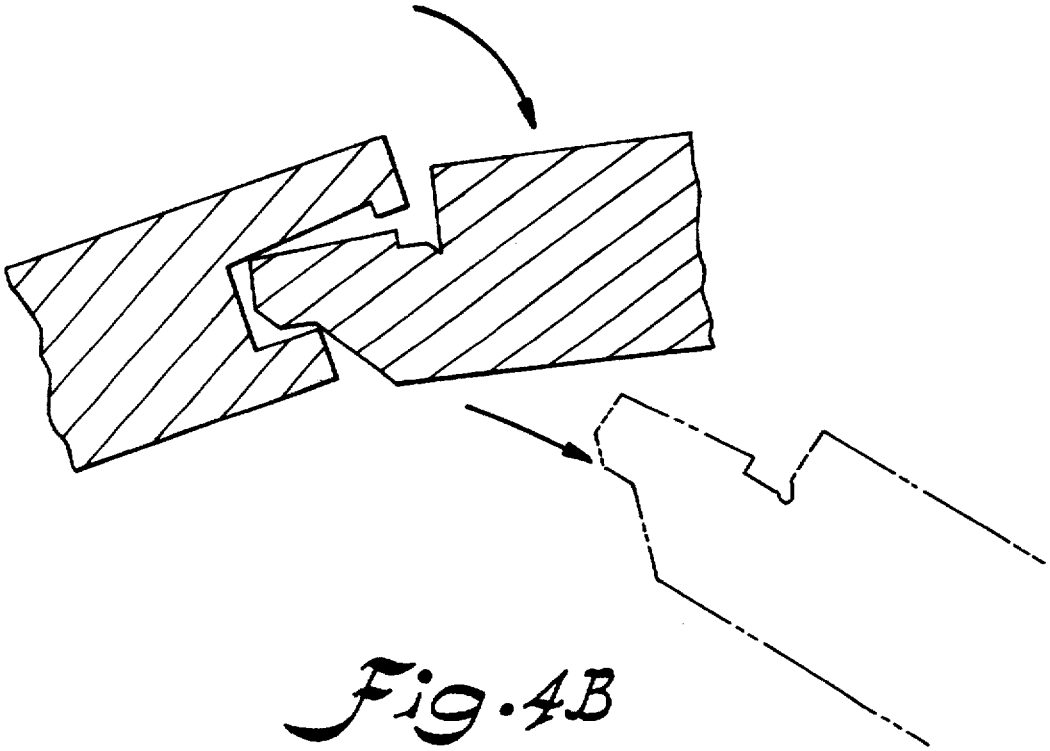
FIG. 4B is a sectional view taken along lines 4B—4B of FIG. 4A.

In the event it is desired to remove flooring system 10, such can be accomplished by a removal method in accordance with the present invention, which is illustrated in FIGS. 4A and 4B. As previously discussed, once ridge 46 has snapped into place within groove 34, the adjacent flooring members 12 cannot be laterally pulled apart from one another. However, by raising the flooring members 12 at the interface between edges A and B, and by rotating the male interface edge B substantially clockwise with respect to the upwardly angled female interface edge A, as illustrated in FIG. 4B, the male interface edge can be separated from the female interface edge A. This is possible because of the undercut 60 provided beneath the tongue 30 of the male interface member edge B, which provides for adequate clearance to be achieved when interface edge B is rotated such that ridge 46 becomes disengaged from groove 34. Once this occurs, interface edge B can be separated from interface edge A, thus allowing the adjacent flooring members 12 to be separated from one another. Worker W is illustrated in FIG. 4A practicing the flooring system removal method illustrated in FIG. 4B.

Figure 5A:
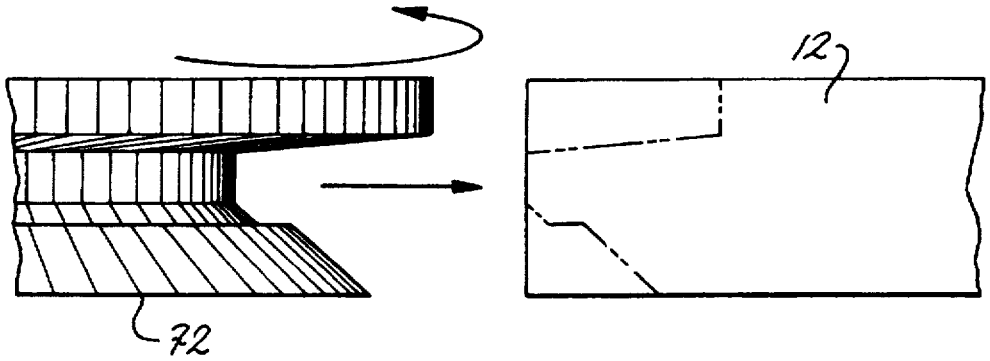
FIG. 5A is a sectional view illustrating the process of forming the basic tongue portion of a longitudinal edge of a flooring member constructed in accordance with the present invention.
Figure 5B:
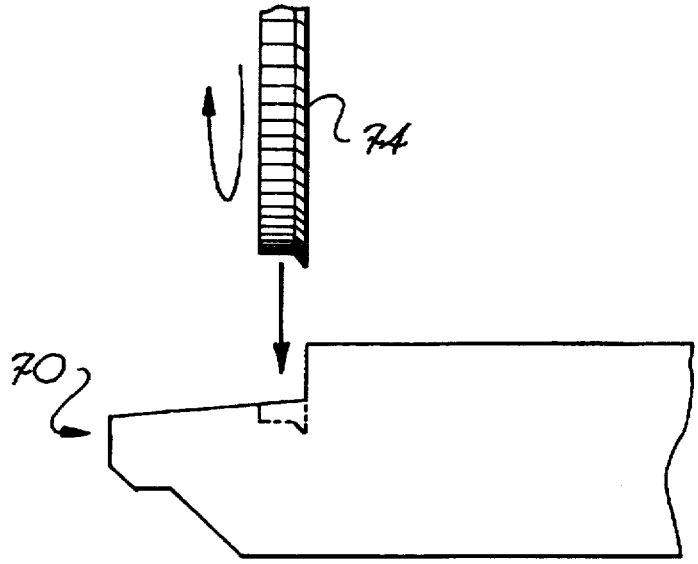
FIG. 5B illustrates the process of forming a notched portion within the tongue formed as shown in FIG. 5A.
Figure 5C:
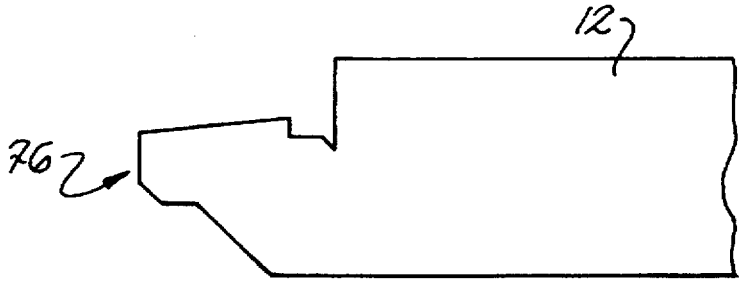
FIG. 5C is a partial side elevational view of one longitudinal edge of a flooring member constructed in accordance with the present invention.

Turning now to the method of the present invention manufacturing flooring members 12, FIG. 5A illustrates an initial step in defining a male interface edge B intermediate profile, generally 70. A cutting tool 72 is used to form the intermediate profile 70. Forming the intermediate profile 70 with tool 72 simultaneously forms undercuts 54,60. Groove 34 is then cut out of profile 70 by means of a second cutting tool 74. The forming of groove 34 by cutting tool 74 is illustrated in FIG. 5B, and the resulting final profile 76 of male interface edge B is illustrated in FIG. 5C.

Figure 6A:
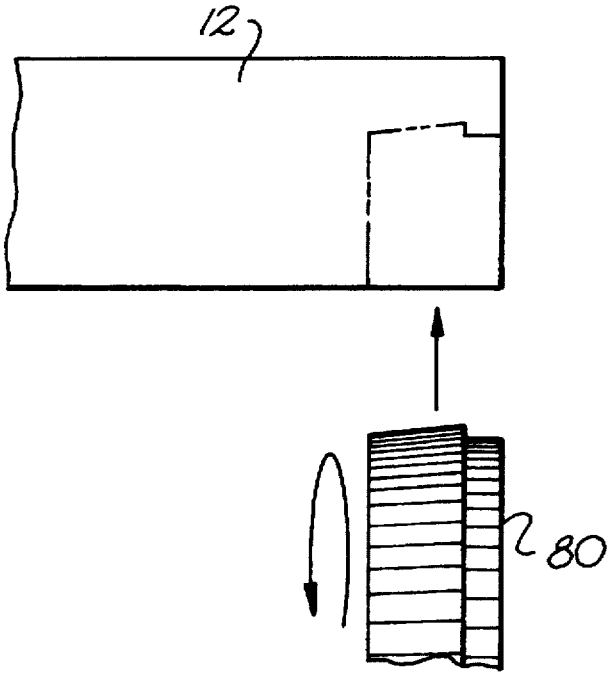
FIG. 6A illustrates the process of forming a barb along the longitudinal edge opposite the longitudinal edge shown in FIG. 5A through 5C of a flooring member.
Figure 6B:
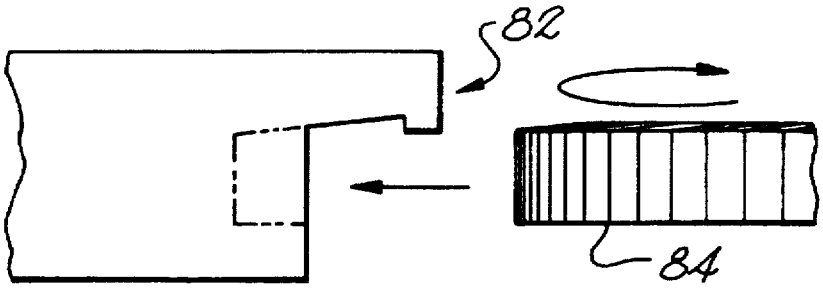
FIG. 6B illustrates forming of a channel in the longitudinal edge of the flooring member illustrated in FIG. 6A.
Figure 6C:
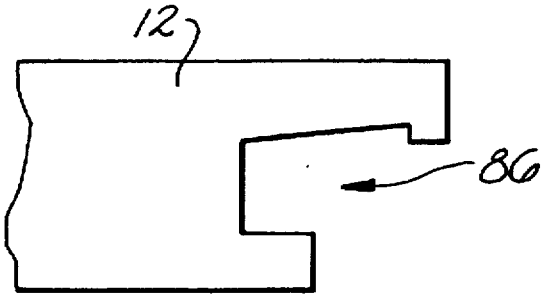
FIG. 6C illustrates a partial side elevational view of the opposite longitudinal edge of a flooring member constructed in accordance with the present invention, as compared to the longitudinal edge of the flooring member illustrated in FIG. 5C.

Now, turning to FIGS. 6A through 6C, the forming method of the profile of female interface edge A of the present invention will be discussed. FIG. 6A illustrates use of a rotating cutting tool 80 which is used to form an intermediate profile 82 in edge A. This intermediate profile includes ridge 46 and also surfaces 48 and 50 of what will ultimately become channel 28 of female interface edge A. FIG. 6B illustrates use of another rotary cutting tool 84 which forms a portion of surface 48, thereby forming the complete, finished end profile 86 of female interface edge A.

Although cutting tools 72,74,80,84 have been illustrated as rotating cutting tools, that could alternately be reciprocating cutting tools, or some other means for providing the desired profiles.

It is to be understood that although the respective interface edges A and B may be formed by the forming methods discussed above, a variety of other methods could also be used to form such profiles. For example, flooring members 12 could be extruded from extrudable material, such as plastic, nylon, metal, ceramic, wood products, or combinations thereof, if desired, with the interface edges A and B of the present invention. Alternately, interface edges A and B could be varied from that illustrated and described herein and still be within the contemplation of the present invention, with the feature allowing the flooring members to be connected to one another through lateral movement, and disconnected from one another through the raising of the members at the connection interface, and rotating one member with respect to the other member in order to separate them from one another.

A significant feature of flooring members 12 is that tongue 30 extends outwardly far enough to allow a saw blade 80 or other cutting member to have clearance to cut the retaining barb, or ridge 46, into tongue portion 30. When flooring members 12 are snapped together, retaining barb 46 prevents members 12 from being pulled apart laterally.

Another feature of the present invention is the use of commonly-available paraffin-based waterproof coating, or some other commonly available wood coating, on interface edges A and B of members 12 to insure a good waterproof coating at the interface of edges A and B.

Flooring members 12, in one preferred embodiment, are preferably constructed of a masonite-type material (low density or height density fiber or wood product). Because of the uniformity of such material, close tolerances can be obtained, thereby allowing for consistent and tight interconnection between adjacent flooring members during installation and use. Natural wood could also be used for making flooring members 12, if desired. waterproofing of the interface edges A and B with the waterproof coating during manufacture should prevent the buckling and blistering of the flooring member material. Flooring system 10 can be easily removed, or mistakes corrected during installation, because of the removal method provided by the cooperating interface edges A and B.

Since the interlocking relationship between adjacent flooring members limits the size of the gap allowable between adjacent flooring members, relatively long flooring members 12 can be produced. This may not be the case in other flooring systems.

While preferred embodiments and methods of the invention have been described using specific terms, such description is for present illustrative purposes only, and it is to be understood that changes and variations to such embodiment methods, including but not limited to the substitution of equivalent features, or steps, and the reversal of various features and steps thereof, may be practiced by those of ordinary skill in the art without departing from the spirit or scope of the following claims.

What is claimed is:

1. A flooring system for use on a generally planar base surface, the flooring system comprising:

a first flooring member and a second flooring member, said first flooring member defining an elongated first engagement portion, and said second flooring member defining an elongated second engagement portion; said first engagement portion cooperating with said second engaging portion for attaching to attach said first and second flooring members together;

said first engagement portion defining an elongated channel extending generally transversely into said first flooring member and generally parallel to said base surface, and said first engagement portion defining a downwardly extending barb adjacent to said channel; and said second engagement portion having an elongated tongue received in said channel, said tongue defining a transversely extending tapered-in end portion projecting outwardly substantially parallel to said base surface and a longitudinally extending groove receiving said barb such that upon receipt of said tongue in said channel and said barb in said groove, said first and second flooring members are connected to one another, whereby said first and second engagement portions are restrained against both lateral movement and upward movement with respect to one another.

2. A flooring system as defined in claim 1, wherein said tongue defines an upper surface and a leading edge adjacent said upper surface, said leading edge defining an undercut portion therein.

3. A flooring system as defined in claim 1, wherein said tongue defines an upper surface and a leading edge adjacent said upper surface, said upper surface sloping upwardly from said leading edge.

4. An elongated flooring member for use in a flooring system for a substantially planar base surface, the flooring member comprising:

an elongated body portion having a first edge and a second edge opposite said first edge, said first edge defining a first engagement portion and said second edge defining a second engagement portion;

said first engagement portion defining an elongated channel extending generally transversely into said first flooring member and generally parallel to said base surface, and said first engagement portion defining a downwardly extending barb adjacent to said channel; and said second engagement portion having an elongated tongue extending outwardly from said second edge, said tongue defining a transversely extending tapered-in end portion projecting outwardly substantially parallel to said base surface and an upper surface, and said upper surface defining a longitudinally extending groove adjacent said second edge.

5. A flooring member as defined in claim 4, wherein said body portion is constructed of compressed wood fibers.

6. A flooring member as defined in claim 4, wherein said body portion is constructed of metal.

7. A flooring member as defined in claim 4, wherein said body portion is constructed of plastic.

8. A flooring member as defined in claim 4, wherein said body portion is constructed of natural wood.

9. A flooring member as defined in claim 5, wherein said body portion includes a surface layer of melamine and aluminum oxide.

10. A method of installing a flooring system for use on a substantially planar base surface, comprising:

providing a first flooring member on said base surface having an elongated first engagement portion with an elongated channel extending generally transversely into said first flooring member and generally parallel to said base surface and a downwardly extending barb adjacent to said channel;

providing a second flooring member having an elongated second engagement portion with an elongated tongue receivable in said channel, said tongue defining a transversely extending tapered-in end portion projecting outwardly substantially parallel to said base surface, and an elongated groove for receiving said barb; and moving one of said first and second engagement portions toward the other of said first and second engagement portions laterally such that said tongue is received in said channel and said barb is received in said groove, thereby substantially fixing said first and second flooring members against lateral movement away from one another.

11. Method of installing and removing a flooring system, comprising:

(a) installing the flooring system by:

(i) providing a first flooring member having a first engagement portion with an elongated channel extending generally transversely into said first flooring member and generally parallel to said base surface and a downwardly extending barb adjacent to said channel;

(ii) providing a second flooring member having a second engagement portion with an elongated tongue receivable in said channel, said tongue defining a transversely extending tapered-in end portion projecting outwardly substantially parallel to said base surface, and an elongated groove for receiving said barb; and (iii) moving one of said first and second engagement portions laterally towards the other of said first and second engagement portions such that said tongue is received in said channel and said barb is received in said groove, thereby substantially fixing said first and second flooring members against lateral movement away from one another; and (b) removing the flooring system by:

(i) simultaneously elevating said first and second engagement portions;

(ii) rotating said second flooring member downwardly with respect to said first flooring member such that said barb becomes disengaged with said groove, and said tongue become disengaged with said channel; and (iii) moving said second flooring member laterally with respect to said first flooring member for disengaging said first and second engagement portions from one another.

12. A method of forming an engagement portion of a flooring member, the method comprising:

providing an elongated flooring member having a substantially horizontally disposed surface, a bottom surface, and a substantially vertical edge portion adjacent thereto;

forming a substantially vertical groove from said bottom surface upward in said edge portion to form a downwardly projecting barb portion using a rotating cutting tool; and forming a substantially horizontal groove with a rotating cutting tool in said vertical edge portion substantially perpendicular to said vertical groove to thereby form a transversely extending channel in said substantially vertical edge portion having said barb projecting downwardly from said edge into said channel.

13. The method as defined in claim 12, further comprising applying a waterproof coating to said vertical edge.

14. A method of forming an engagement portion of a flooring member, the method comprising:

providing an elongated flooring member having a substantially horizontally disposed surface and a substantially vertical edge portion adjacent thereto;

forming an outwardly projecting tongue in said vertical edge portion with a rotating cutting tool, said tongue defining a transversely extending tapered-in end portion projecting outwardly and substantially parallel to said horizontally disposed surface and extending substantially perpendicularly with respect to said vertical edge portion; and forming a longitudinal groove in said tongue adjacent and substantially parallel to said vertical edge portion.

15. The method as defined in claim 14 further comprising applying a waterproof coating to said tongue and said groove.

* * * * *

UNITED STATES PATENT AND TRADEMARK OFFICE

CERTIFICATE OF CORRECTION

PATENT NO : 5,797,237

DATED : August 25, 1998

INVENTOR(S): Finkell

It is certified that error appears in the above-identified patent and that said Letters Patent is hereby corrected as shown below:

Column 7, line 16, delete "for attaching"

Signed and Sealed this

Fifteenth Day of December, 1998

Bruce Lehman

*Attest:*

BRUCE LEHMAN

*Attesting Officer*

*Commissioner of Patents and Trademarks*